US005778986A

United States Patent [19]

Davis

[11] Patent Number: 5,778,986

[45] Date of Patent: Jul. 14, 1998

[54] DEVICE TO REMOVE DIVOTS

[76] Inventor: Floyd A. Davis, 256 Moraine Rd., Highland Park, Ill. 60035

[21] Appl. No.: 906,462

[22] Filed: Aug. 5, 1997

[51] Int. Cl.[6] ..... A63B 55/10

[52] U.S. Cl. ..... 172/378; 294/50.9; 473/408

[58] Field of Search ..... 473/282, 286, 473/408; 294/50.7, 50.9; 172/378, 379, 380

[56] References Cited

U.S. PATENT DOCUMENTS

| | | | |
|---|---|---|---|
| 1,466,168 | 8/1923 | Holton . | |
| 1,885,377 | 11/1932 | Robinson . | |
| 3,168,150 | 2/1965 | Kappler . | |
| 3,567,264 | 3/1971 | Baber . | |
| 4,013,295 | 3/1977 | Baughman . | |
| 4,179,147 | 12/1979 | Mendenhall | 294/50.7 |
| 4,846,286 | 7/1989 | McNeely | 172/379 |
| 4,862,970 | 9/1989 | Hlavacek . | |
| 4,884,805 | 12/1989 | Patterson . | |
| 4,955,609 | 9/1990 | Kassen . | |
| 5,322,130 | 6/1994 | Ryden . | |
| 5,437,449 | 8/1995 | Zink . | |

*Primary Examiner*—Sebastiano Passaniti
*Assistant Examiner*—Stephen L. Blau
*Attorney, Agent, or Firm*—Lee, Mann, Smith, McWilliams, Sweeney & Ohlson

[57] ABSTRACT

A golf divot repair device having downwardly and inwardly disposed fingers to be forced into the green around a divot by foot pressure and/or pushing down on attached golf club, the fingers being rotatable into a flat position to provide a compact package than can be carried in the golfer's pocket or golf bag.

6 Claims, 2 Drawing Sheets

DEVICE TO REMOVE DIVOTS

BACKGROUND OF THE INVENTION

This invention relates to the removal or repair of divots on golf course greens.

Almost every time a golf ball hits a green from any distance, it leaves a mark. If the green is soft because of water or weather conditions, the mark may be very deep and damaging to the surface of the green. These marks are generally referred to as divots. It is customary in the game of golf for the golfer to repair the divot that he makes on the green.

Many devices have been designed for this purpose including simple hand held devices that look like double toothpicks which are stuck into the green surface to pry up the divot mark and rather complicated and sophisticated devices. Examples of these are shown in Zink U.S. Pat. No. 5,437,449 entitled Golf Club Holder and Turf Repair Tool; Baber U.S. Pat. No. 3,567,264 entitled Implement for Removing Indentatations Mendenhall U.S. Pat. No. 4,179,147 entitled Golf Green Tool; Ryden U.S. Pat. No. 5,322,130 entitled Golf Ball Mark Repair Tool; Kassen U.S. Pat. No. 4,955,609 entitled Golf Club With Green Surface Repair Device; Patterson U.S. Pat. No. 4,884,805 entitled Turf Repair Apparatus; Hlavacek U.S. Pat. No. 4,862,970 entitled Greens Repair Tool; and Baughman U.S. Pat. No. 4,013,295 entitled Golfer's Positioning and Retrieving Device. All of the devices shown in the referenced patents are useable to repair divots on golf greens but most of them are somewhat cumbersome and difficult to carry. This is a problem because either the golfer or his caddie normally must carry a golf bag full of clubs and carrying additional equipment could pose a problem.

It is, therefore, an object of the invention of this application to overcome the disadvantages of the prior art divot repair devices and to provide a handy easy to carry and simply designed divot repair device.

BRIEF SUMMARY OF THE INVENTION

It is an object of the present invention to provide a divot repair device which can be folded into a reasonably flat condition so that it can be easily carried in a pocket or in a golf bag and which also has the ability to be attached temporarily to the grip end of a club for use in repairing divots.

The device has a further advantage that it includes flanges which can be used by the golfer to step on to operate the prongs of the device and push them into the green to repair the divot marks.

Other objects of this invention and uses for the device disclosed herein will become obvious from the description of the drawings and the detailed description of the invention.

DETAILED DESCRIPTION OF THE INVENTION

Figure 1:
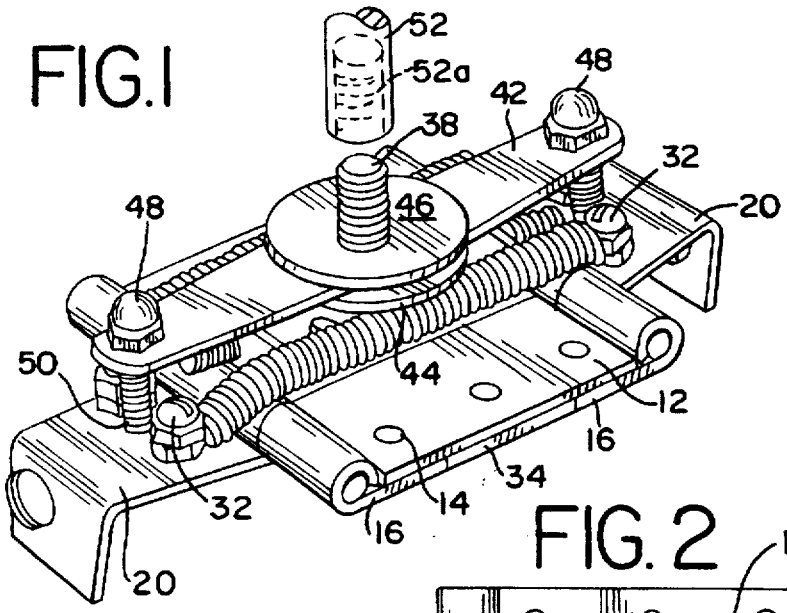
FIG. 1 is a perspective view of the device to remove divots of this invention showing the device in a folded condition.

The divot remover 10 of this invention includes a base plate 12 which is riveted at 14 to a pair of hinge plates 16. The hinge plates support a pair of hinges 18 which hingedly support a pair of finger plates 20. The finger plates 20 are angled at **20*a* to provide a support area for a pair of fingers 22. The fingers are held in place in the angled portion 20*a* of the finger plate 20 by a pair of nuts 24. The fingers 22 are threaded so that the nuts 24 can be advanced up the fingers to abut the angled portion 20*a* of the finger plates 20**. The threaded fingers as will be explained later, may also play a role in the removal of the divots.

The finger plates 20, as previously mentioned, are hingedly attached to the hinge plates 16 so that they may rotate about the hinge pin 26. The fingers 22 along with the finger plate 20 may be rotated to the closed position as shown in FIG. 4 or they may be in the position shown in FIG. 3 which is the angled or operable position. The finger plates 20 are spring loaded by the springs 28 into the open position and the finger plates 20 are prevented from rotating past the position shown in FIG. 3 by stop bolts 30. The springs 28 are connected to the finger plates 20 by a pair of bolts 32 so that they are operable to maintain the fingers 22 and the finger plates 20 in the position shown in FIG. 3.

The base plate 12 is also riveted to a center plate 34 to provide strengthening for the base plate and a U-shaped support 36 which supports the stop bolts 30 and an upstanding support column 38 which is bolted at 40 to the U-shaped support 36.

The support column 38 supports a first washer disk 44, a second washer disk 46 and a pair of locking levers 42 therebetween. The locking levers 42 are rotated about the support column 38. Each of the locking levers 42 includes a gripping knob 48 located at its outer end.

Figure 2:
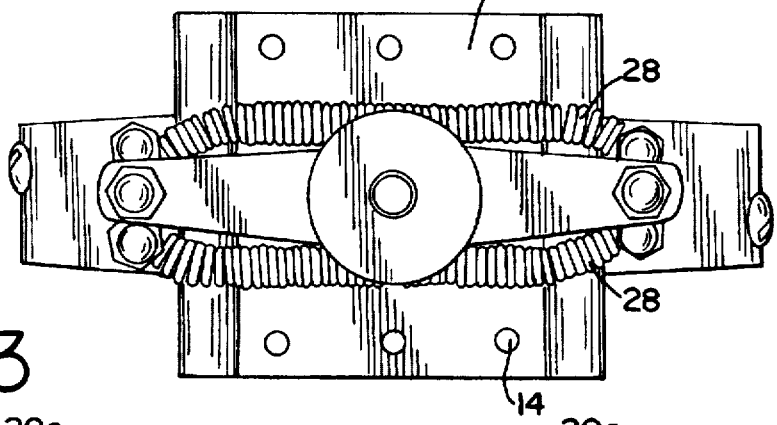
FIG. 2 is a top plan view of the divot removing device of this invention.
Figure 3:
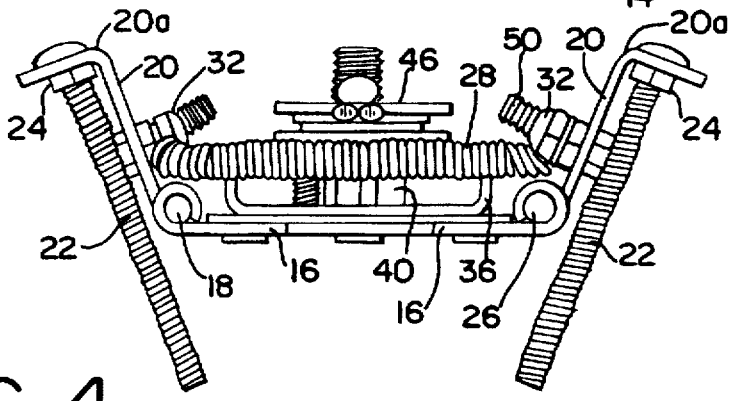
FIG. 3 is a side view of the divot removing device of this invention showing the prongs extended.
Figure 4:
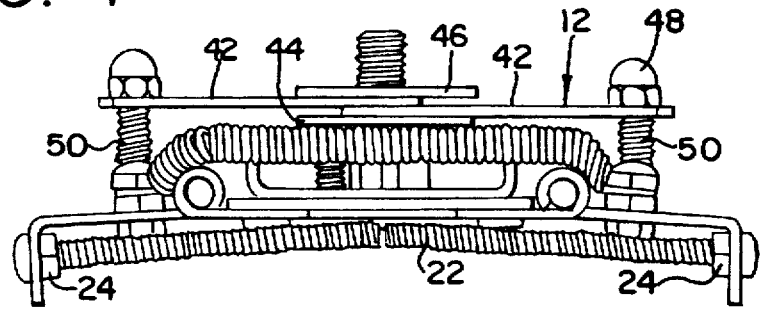
FIG. 4 is a side view of the divot removing device of this invention with the prongs folded, i.e., in the condition as shown in FIG. 1.

When the fingers 22 and finger plates 20 are in the position shown in FIG. 3, the locking levers 42 win be rotated out of the position shown in FIG. 2. This is the operable position for the fingers 22 and the locking levers 42. When it is desired to lock the fingers out of the operable position into the position shown in FIG. 4, the locking levers 42 are rotated into the position shown in FIG. 4 so that they abut the bolts 50 which are attached to the finger plates 20. In the position shown in FIG. 4 the locking levers effectively lock the fingers 22 into the closed position.

The support column 38 extends upwardly from the divot remover and it too is threaded so that it may be attached to the end of a golf club or other elongated member for use of the divot remover. Non threaded attachments are also possible (see FIG. 5).

Use of the divot remover as shown in FIGS. 1 through 4 will now be described. In the position shown in FIG. 3 with the base plate in a substantially horizontal position and with the fingers 22 angularly extended downwardly, the divot remover is placed over a divot on a green and the fingers 22 are forced into the turf surrounding the divot. Though the fingers 22 are shown as threaded, they need not be. The fingers 22 threaded or unthreaded cause the earth around and underneath the divot to be moved inwardly as are the fingers 22 themselves. Further forcing of the divot remover 10 downwardly causes the hinged plates 16 and the center plate 34 to abut the ground. The ground is forced, therefore, inwardly and upwardly by the mechanism fingers which effectively forces the divot back into a flat position against the center plate 34. The movement downwardly can be effected by a golf club handle 52 shown partially in a stylized position with the inner portion 52*a* threaded to receive the support column 38. The flat surface of the base plate 12 can also be used by imposing the golfer's toe on the plate to force the divot remover 10 downwardly into position around the divot to be removed. Thereafter the divot remover 10 is withdrawn from the ground. The fingers are rotated inwardly so that the locking levers 42 can be turned into place over the bolts 50 thereby holding the fingers in the position shown in FIG. 4. In this position the divot remover once removed from a golf club or the like can be carried in the golfer's pocket or in the golf bag without any difficulty.

Figure 5:
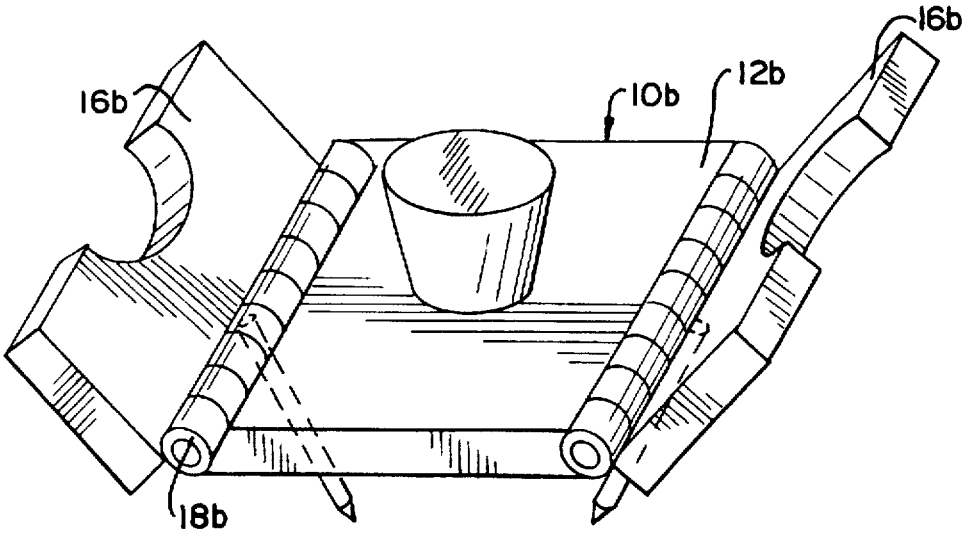
FIG. 5 is a conceptualized and a modernized perspective view of the golf device of this invention which is representative in form.
Figure 6:
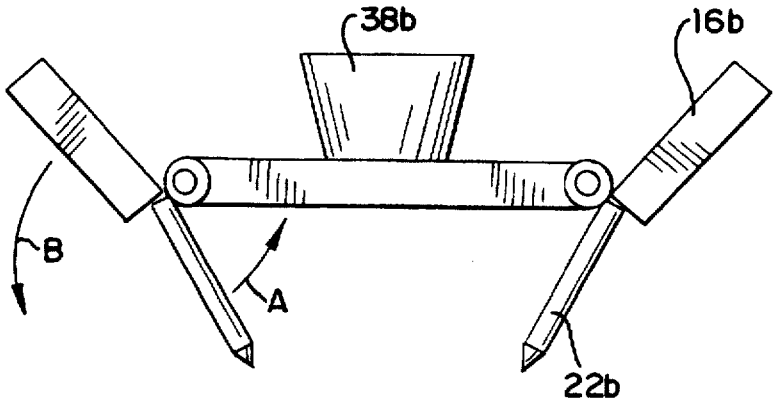
FIG. 6 is a side view of the device shown in FIG. 5.
Figure 7:
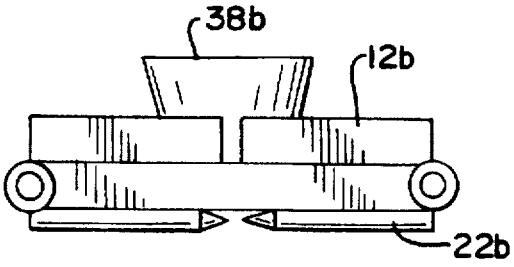
FIG. 7 is a side view of the device shown in FIG. 5 in a folded condition.

Referring now to FIGS. 5 through 7, these are stylized views of the divot remover of this invention 10*b*. This construction includes a base plate 12*b*, hinge plates 16*b*, hinges 18*b* and fingers 22*b*. The springs would operate in a similar fashion as shown in connection with the embodiment of FIGS. 1 through 4 although the springs are not shown in the construction in the embodiment of FIGS. 5 through 7. Leaf springs or other type springs can also be used. FIG. 6 depicts a stylized divot remover with the fingers 22*b* extended in an operable position although these fingers are not necessarily threaded. The arrows A and B indicate the movement of the hinged plates 16*b* and the fingers 22*b*. FIG. 7 shows the divot remover with the fingers flattened against the underside of the base plate 12*b*. The support column 38*b* would be used to place the stylized version of FIG. 10*b* over the divot to be removed whereupon the base plate is forced downwardly by the golfer's toe to remove the divot. In like fashion the support column 38*b* can be attached by means (not shown) to a golf club or other extended member.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A divot repair device comprising:

a) a substantially horizontal base;

b) at least two fingers hingedly attached to said base;

c) means for resiliently holding said fingers in an operable downwardly extending position from said base; and d) means for overcoming said resilient means and for rotating said fingers into an inoperable flat position with respect to said base.

2. The divot repair device of claim 1 wherein said fingers are attached to finger plates which are hingedly attached to said base.

3. The divot repair device of claim 1 wherein said means for resiliently holding said fingers is a spring.

4. The divot repair device of claim 1 wherein said means for overcoming said resilient means is a pair of locking levers operable to force said fingers into an inoperable flat position.

5. The divot repair device of claim 2 wherein a pair of springs are attached to said finger plates to hold said plates in an upward position whereby said fingers are held in an operable downwardly and inwardly extending position.

6. The divot repair device of claim 1 wherein said base is an extensive flat surface adapted to receive downward force from a golfer's toe, said fingers are attached to a pair of finger plates which are hingedly attached to said base, said means for resiliently holding said fingers is a pair of springs attached to said finger plates whereby said fingers are held in an operable downwardly and inwardly extending position and said means for overcoming said resilient means is a pair of locking levers rotatably supported on said base and operable to force said finger plates into a position coplaner with said base whereby said fingers are held in an inoperable flat position.

* * * * *